United States Patent [19]

Focke et al.

[11] Patent Number: 4,779,723

[45] Date of Patent: Oct. 25, 1988

[54] PACK COMPRISING A SLIDE AND SHELL

[75] Inventors: Heinz Focke; Kurt Liedtke, both of Verden, Fed. Rep. of Germany

[73] Assignee: Focke & Co., Verden, Fed. Rep. of Germany

[21] Appl. No.: 57,992

[22] Filed: Jun. 4, 1987

[30] Foreign Application Priority Data

Jun. 6, 1986 [EP] European Pat. Off. ..... 86107895

[51] Int. Cl.[4] ..... B65D 85/10

[52] U.S. Cl. ..... 206/273; 229/19; 229/87 C

[58] Field of Search ..... 206/273, 491, 271, 275, 206/814; 229/109, 9, 19, 120.18, 106, 87 C

[56] References Cited

U.S. PATENT DOCUMENTS

| | | | |
|---|---|---|---|
| 1,324,578 | 12/1919 | Bard | 229/87 C |
| 2,001,478 | 5/1935 | Vogt | 206/491 X |
| 2,086,169 | 7/1937 | Molins | 229/9 X |
| 2,751,138 | 6/1956 | Laver | 229/109 |
| 3,348,757 | 10/1967 | Hickin et al. | 229/100 |
| 3,752,308 | 8/1973 | Begemann | 206/273 X |
| 4,020,988 | 5/1977 | Kipp | 229/106 |
| 4,119,196 | 10/1978 | Flaherty | 206/271 |
| 4,199,098 | 4/1980 | Lopez | 229/109 X |
| 4,260,100 | 4/1981 | Hoffman | 229/109 |
| 4,494,689 | 1/1985 | Ilitch | 229/19 X |

FOREIGN PATENT DOCUMENTS

| | | | |
|---|---|---|---|
| 395501 | 7/1933 | United Kingdom | 229/9 |
| 1254695 | 11/1971 | United Kingdom | 206/271 |

*Primary Examiner*—David T. Fidei

*Attorney, Agent, or Firm*—Sughrue, Mion, Zinn, Macpeak and Seas

[57] ABSTRACT

A pack consisting of a shell (10) and a slide (11) and intended for receiving cigarettes (cigarette blocks 12, 13) has an octagonal cross-section of the shell (10), with longitudinal edges (27) which each consist of two individual edges (28and 29) joined to one another by means of a strip of material (30) going across the angle. As a result, side tabs (16, 17) of the slide (11) have less width, and there is a corresponding saving of material.

3 Claims, 4 Drawing Sheets

PACK COMPRISING A SLIDE AND SHELL

BACKGROUND OF THE INVENTION

The invention relates to a pack comprising a slide and a shell, especially for receiving at least one group of cigarettes (i.e. a cigarette block) wrapped in an inner blank.

Packs of the slide-and-shell type serve mainly for receiving cigarette groups which are wrapped in an inner blank made of tin foil. The shell surrounding the slide is of square or rectangular cross-section and open at both ends. The slide consists of a rear wall, on which the cigarette block rests, and of side tabs which rest against side walls of the shell. Transversely to these extend end walls (i.e. a bottom wall and a top wall) of the slide with insertion flaps.

SUMMARY OF THE INVENTION

The object of the invention is to develop the pack of the slide-and-shell type further in technical and design terms, in particular also from the point of view of the saving of material.

To achieve this object, the pack according to the invention is characterized in that longitudinal edges of the shell and longitudinal edges between the rear wall and the side tabs of the slide are bevelled to match the diameter of the cigarettes, in such a way that the shell has an octagonal equiangular cross-section.

The bevelled longitudinal edges of the shell and, if appropriate, of the slide ensure that the cross-sectional shape of the pack matches that of the cigarette block more closely and more exactly. Because of the bevelled longitudinal edges, there is no need for the corner cavities otherwise formed in the region of the longitudinal edges as a result to the rounded shape of the cigarettes.

According to the invention, the slide is designed in a special way and has a bottom wall and top wall with bevelled corners. Insertion flaps are provided laterally with extensions which, in the closing position, match the octagonal contour of the pack.

Further features of the pack according to the invention relate to the design or dimension of the side tabs of the slide and to the shape of the shell.

An exemplary embodiment of the invention is explained in detail below with reference to the drawings.

DETAILED DESCRIPTION OF A PREFERRED EMBODIMENT

The pack type under consideration here consists, in terms of its basic structure, of two parts, namely an outer shell 10 and a slide 11 arranged movably in the latter. Placed in the slide 11 is the pack content, in the present case two cigarette blocks 12 and 13, that is to say cigarette groups wrapped in an inner blank 14 of tin foil.

Figure 1:
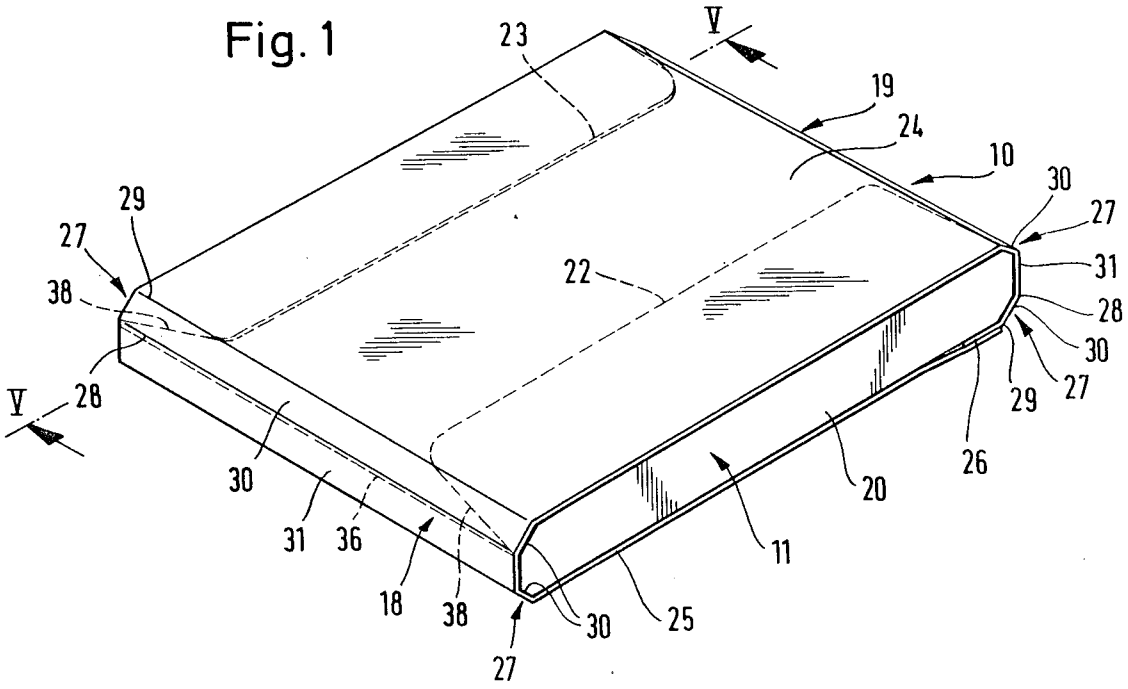
FIG. 1 shows a perspective representation of a closed pack of the slide-and-shell type of octagonal cross-section.
Figure 2:
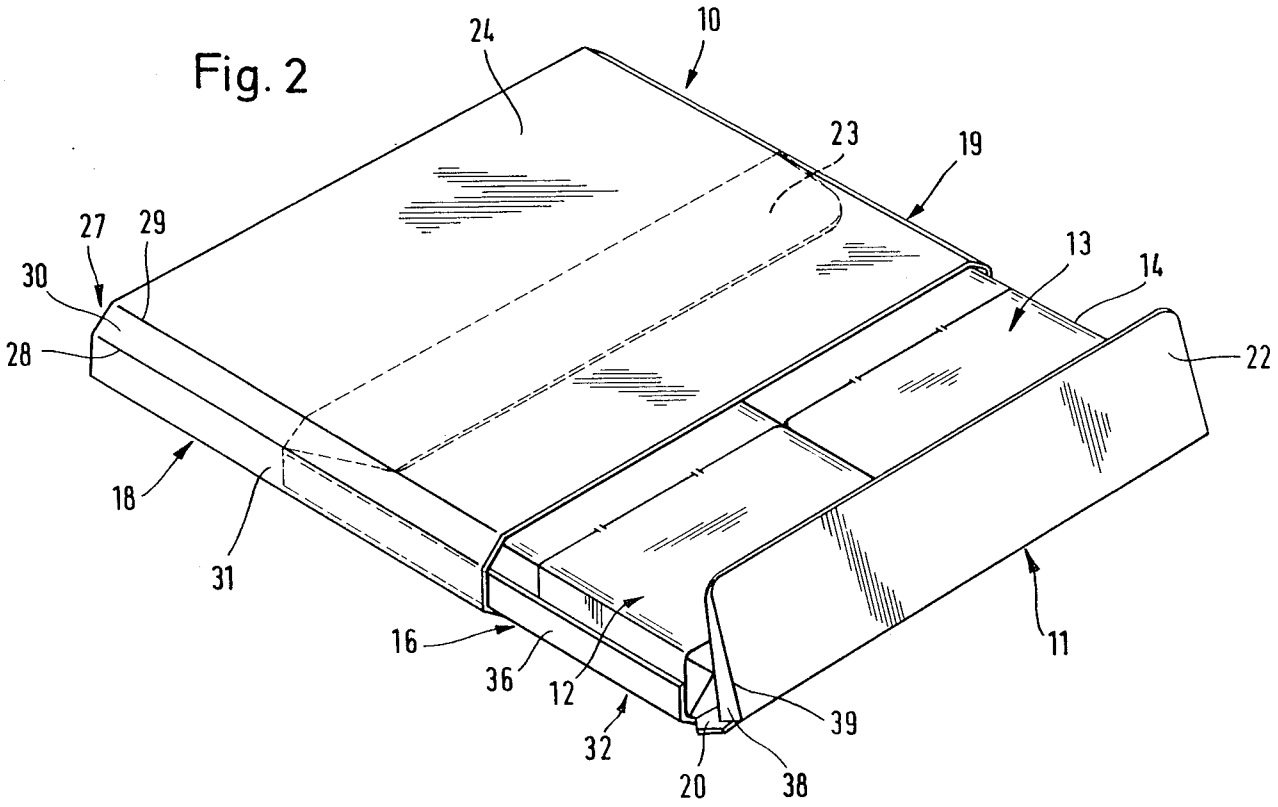
FIG. 2 shows the pack according to FIG. 1 in the opened position.
Figure 4:
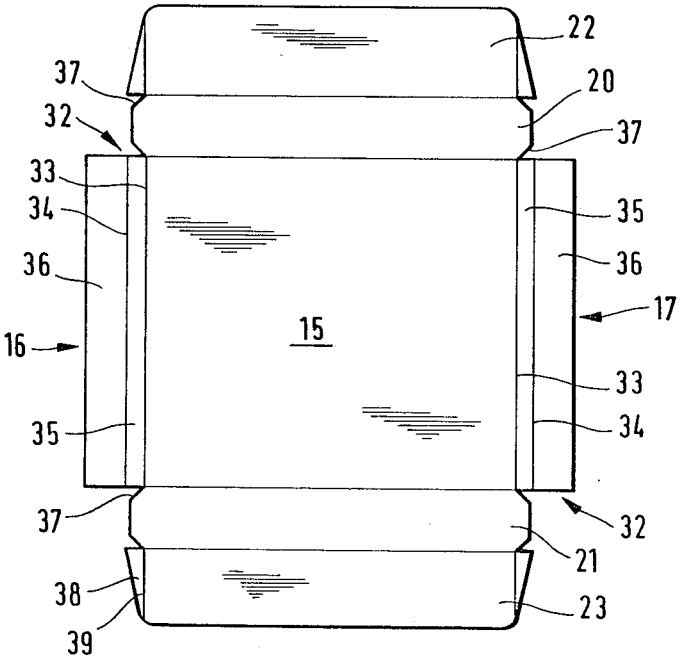
FIG. 4 shows a spread-out blank for forming the slide.

The shell 10 is an approximately cuboid structure of continuous cross-section, which is open at the ends or the top and bottom. As a result, the slide 11 can be moved through the shell 10, specifically up and down. When the slide 11 is partially moved out of the shell 10 in this way (FIG. 2), the pack content can be extracted.

The slide 11 consists of a rear wall 15, on or against which rests the pack content (cigarette blocks 12, 13). Raised side tabs 16 and 17 adjoin the rear wall 15 laterally and, within the shell 10, rest against side walls 18 and 19 of the shell 10. Transversely to these extend, at the ends or at the top and bottom edges of the rear wall 15, end walls, namely a top wall 20 and a bottom wall 21. These are directed transversely relative to the rear wall 15 and form the top and bottom ends of the (raised) pack. Attached to the top wall 20 and bottom wall 21 respectively are insertion flaps 22 and 23. When the pack is closed, these are folded round against the pack content and extend between a shell front wall 24 and the pack content in order to secure the closing position.

Figure 3:
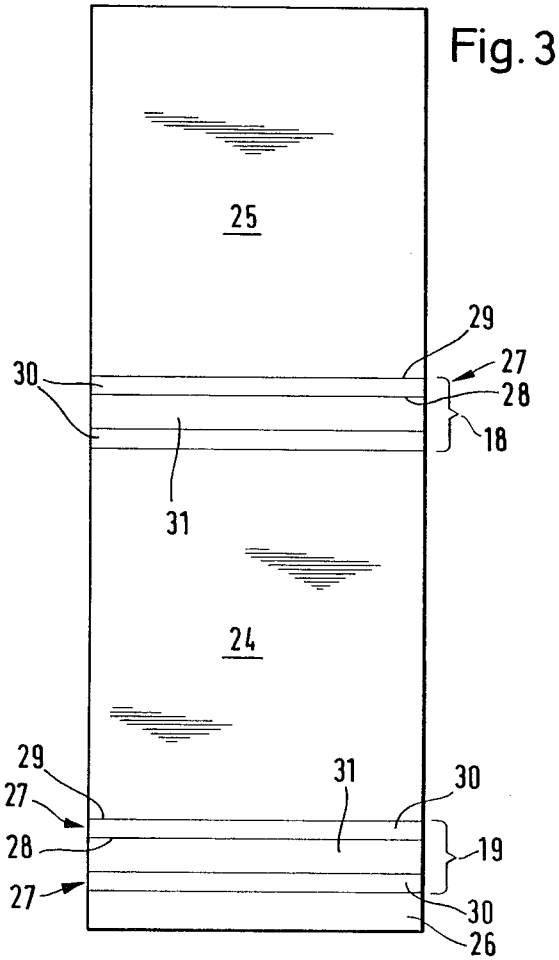
FIG. 3 shows a spread-out blank for forming the shell.
Figure 5:
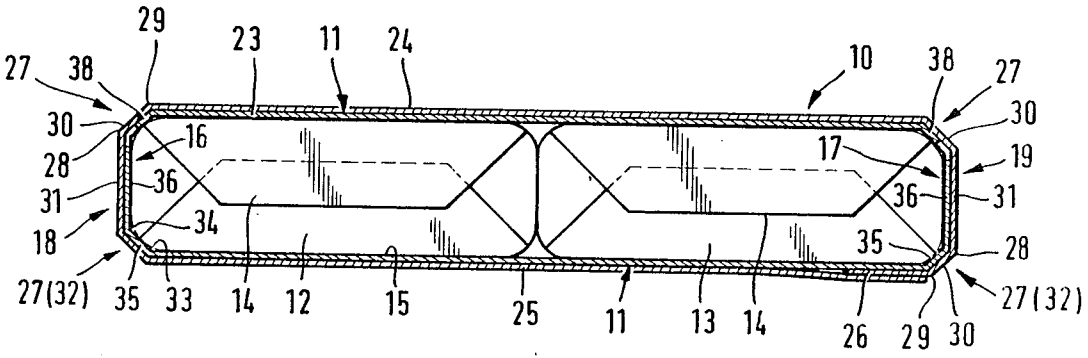
FIG. 5 shows a cross-section through the pack according to FIG. 1 in the plane V—V.

A blank for forming the shell 10 (FIG. 3) is an elongate rectangular structure, when spread out. This is folded into a "tube" of approximately cuboid cross-section, in such a way that a shell front wall 24, side walls 18 and 19 and a shell rear wall 25 are formed. In the region of the latter, a tube overlap 26 of the blank of the shell 10 is formed. The regions covering one another are joined together by adhesive bonding (FIG. 5).

The shell 10 forms four longitudinal edges 27 which, when the pack stands up, extend in the vertical direction. In the present case, the longitudinal edges are each bevelled by angling the blank of the shell 10 twice. This results in the octangonal cross-section of the shell 10. Instead of the continuous rectangular edges of conventional packs, here two individual edges 28 and 29 are obtained in the region of each longitudinal edge 27. The individual edges 28 and 29 are joined together by means of a strip of material 30 extending diagonally "across the angle". If the shell 10 is equiangular in the region of the longitudinal edges 27, and angle of 135° if formed at each individual edge 28, 29. The strips of material 30 are consequently matched relatively closely to the rounded shape of the cigarettes in the region of the corners of the pack.

Because the longitudinal edges 27 are designed in the way described above, the side walls 18, 19 of the shell 10 consist, in the middle region, of a relatively narrow side-wall strip 31 directed transversely relative to the shell front wall 24 and shell rear wall 25.

The shape of the slide matches that of the shell 10. In conformity with the adjacent longitudinal edges 27 of the shell 10, the longitudinal edges 32 of the slide are likewise made as bevelled edges with two individual edges 33 and 34 running at a distance from one another and with a strip of material 35 extending between these and going "across the angle". This then has adjoining it a vertical or transversely directed side-tab strip 36 as part of the side tabs 16, 17.

As a result of the abovementioned design, the side tabs 16, 17 have a smaller constructive height or width than the entire side wall 18, 19 of the shell. As emerges particularly from FIGS. 2 and 5, the side tabs 16, 17 or their side-tab strips 36 extend only in the region of the side-wall strips 31. This results in a saving of material because of the smaller heights or width of the side tabs 16, 17 of the slide 11.

The top wall 20 and bottom wall 21 are matched to the octagonal cross-sectional shape of the shell 10, specifically as a result of a likewise octagonal shape obtained by means of bevelled corners 37. Their shape corresponds to that of the longitudinal edges 27 or of the longitudinal edges 32 of the slide, so that positive matching is obtained.

The insertion flaps 22 and 23 are likewise designed in a special way, specifically with lateral extensions 38 which extend respectively in the region of longitudinal edges 32 of the slide or their strips of material 35. The extensions 38 in the present case tapering in triangular form towards the ends or free edges of the insertion flaps 22, 23 are delimited from the remaining part of the insertion flaps 22, 23 by a folding line 39 corresponding to the inner individual edge 33 of the longitudinal edge 32 of the slide. It is thereby possible, when the pack is closed, to bring the triangular extensions 38 into a bevelled position to conform to the octagonal cross-sectional shape. The stability of the pack, especially in the region of the insertion flaps 22, 23, is consequently increased.

Otherwise, the construction and handling of the pack correspond to those of a conventional design of the "slide-and-shell" type.

What is claimed is:

1. A pack comprising a slide and a shell, for receiving at least one group of cigarettes wrapped in an inner blank, each of said slide and said shell having longitudinal edges, characterized in that the transverse cross-section of each of the slide and shell is rectangular except at said longitudinal edges;

in that the longitudinal edges (27) of the shell (10) and the longitudinal edges (32) of the slide are bevelled between a rear wall (15) and side tabs (16, 17) of the slide (11) to match the diameter of the cigarettes, in such a way that the shell (10) has an octagonal equiangular cross-section;

in that the side tabs (16, 17) on the rear wall (15) of the slide (11) are made with less width than side walls (18, 19) of the shell, so that the side tabs (16, 17) extend between the bevelled longitudinal edges (27) of the shell (10) by means of a side-tab strip (36);

in that the width of the bevelled longitudinal edges (27) of the shell (10) is less than the width of side-wall strips (31) of the shell (10);

in that a top wall (20) and a bottom wall (21) of the slide (11) are located opposite one another and have bevelled corners (37) which conform to the bevel of the longitudinal edges (27); and in that the covering flaps (22, 23) adjoining the top wall (20) and bottom wall (21) of the slide (11) have angled extensions (38) which are directed obliquely at the sides and which, when the pack is closed, rest positively against the inner face of the adjacent bevelled longitudinal edges (27) of the shell (10).

2. Pack according to claim 1, characterized in that the extensions (38) are designed to taper in triangular form towards the free edge of the insertion flap (22, 23).

3. Pack according to claim 2, characterized in that the shell (10) consists of a blank folded in tubular form, with tubular tab strips (26) overlapping one another in the region of a shell rear wall (25).

* * * * *